United States Patent [19]

Cherbonnier

[11] Patent Number: 4,886,397

[45] **Date of Patent: * Dec. 12, 1989**

[54] DYNAMIC LOAD COMPENSATING SYSTEM

[76] Inventor: T. Dave Cherbonnier, 57 Kheam Hock Road, Singapore 1129, Singapore

[ * ] Notice: The portion of the term of this patent subsequent to May 5, 2004 has been disclaimed.

[21] Appl. No.: 90,130

[22] Filed: Aug. 27, 1987

[51] Int. Cl.[4] ..... E21B 7/12; E21B 19/09

[52] U.S. Cl. ..... 405/195; 114/264; 166/355; 175/5

[58] Field of Search ..... 405/148, 195, 196, 202, 405/205, 211, 212, 214, 215, 224, 290, 291, 296; 114/264, 265; 166/350, 355, 359, 367; 175/5, 7; 188/266; 248/588; 254/9 R; 267/160

[56] References Cited

U.S. PATENT DOCUMENTS

| | | | |
|---|---|---|---|
| Re. 27,261 | 12/1971 | Bromell et al. | 114/264 |
| 1,781,063 | 11/1930 | Jessen | 405/290 X |
| 2,517,612 | 8/1950 | Varian . | |
| 2,842,939 | 7/1958 | D'Auriac | 405/214 |
| 3,472,032 | 10/1969 | Howard | 114/264 X |
| 3,714,995 | 2/1973 | Hanes et al. | 175/5 |
| 3,721,293 | 3/1973 | Ahlstone et al. | 175/5 X |
| 3,743,249 | 7/1973 | Van Daalen | 175/7 X |
| 3,749,367 | 7/1973 | Joubert et al. . | |
| 3,752,432 | 8/1973 | Lowe | 248/588 X |
| 3,791,628 | 2/1974 | Burns et al. . | |
| 3,794,125 | 2/1974 | Nelson . | |
| 3,996,753 | 12/1976 | Lubojatsky et al. | 405/296 X |
| 4,362,438 | 12/1982 | Spink | 405/195 |
| 4,364,323 | 12/1982 | Stevenson | 405/195 X |
| 4,379,657 | 4/1983 | Widiner et al. | 405/195 |
| 4,449,854 | 5/1984 | Nayler . | |
| 4,511,115 | 4/1985 | Ludwigsen . | |
| 4,576,517 | 3/1986 | McCann et al. | 405/195 |
| 4,662,786 | 5/1987 | Cherbonier | 405/195 |

FOREIGN PATENT DOCUMENTS

| | | | |
|---|---|---|---|
| 709400 | 8/1941 | Fed. Rep. of Germany . | |
| 1920696 | 6/1978 | Fed. Rep. of Germany | 248/588 |
| 606919 | 5/1978 | U.S.S.R. | 405/203 |
| 1511696 | 5/1978 | United Kingdom . | |
| 2168944A | 7/1986 | United Kingdom . | |

*Primary Examiner*—David H. Corbin
*Attorney, Agent, or Firm*—William W. Haefliger

[57] ABSTRACT

A dynamic load compensation system for supporting a crown block comprises:

(a) first structure including the crown block to receive applied loading, and subject to displacement generally in the direction of load exertion, (b) a base frame spaced from that structure, and (c) means including groups of fluid actuator members pivotally connected to the base frame and to that structure for supporting same on the base frame, said members acting to resist such displacement of the structure characterized in that said base frame may move relatively toward and away from the structure while said loading continues to be applied to the structure, (d) the actuators in each group extending in parallel relation.

A sheave is typically offset from the crown block to control a line or lines leading to the crown block; and two pivoting links connect the sheave with the base frame and block.

20 Claims, 11 Drawing Sheets

DYNAMIC LOAD COMPENSATING SYSTEM

This application is a continuation-in-part of my prior application Ser. No. 35,784, filed Apr. 8, 1987, which is a continuation-in-part of my prior application, Ser. No. 783,679, filed Oct. 3, 1985.

BACKGROUND OF THE INVENTION

This invention relates generally to motion compensation, and more particularly to improvements in heavy duty compensating devices making them simpler, more effective and reliable. More specifically it concerns multiple actuators and sheave support and control mechanism.

There is need for simple, effective reliable, heavy duty, motion and load compensating equipment. For example, helicopter landing pads should support a predetermined load and dissipate additional loading, to compensate for and nullify additional forces exerted as a result of deck "heave", on a vessel. A desirable "shock deck" should also compensate for a "hot" landing or inadvertent rapid descent rate, of the helicopter, and which might otherwise adversely affect the structural integrity of the deck support structure.

In the case of a floating offshore drilling vessel, it cannot inherently provide a constantly stable platform as related to the sub-sea well head. In this regard, a stable reference is required for landing and retrieving of wellhead and blow out prevention equipment, control of string weight on the drill bit in the hole, landing of casing and liner, coring, well logging and fishing. There is need for nullification of the effects of rig/platform heave in response to swelling seas, and for compensating apparatus that will maintain a predetermined lifting force.

Prior Drill String Compensators (D.S.C's) sometimes called heave compensators, are of two types:

1. Block mounted, or
2. Crown mounted

Block mounted compensators, substantially increase the weight applied to the draw works, require precise alignment of derrick track and dollys, and represent a substantial change in the deck loading arm by their movement up and down the derrick. Crown mounted compensators, overcome these major disadvantages, but still add a significant weight to the crown of the derrick. These two methods share some common disadvantages:

1. Stroke/compensation length is equal to rod length or must incorporate chains and sheaves which add additional wear/failure areas.
2. Rig heave compensation causes compression or expansion of compressed air, which in turn causes an inverse reaction in the compensating force applied.

SUMMARY OF THE INVENTION

It is a major object of the invention to provide a compensation system meeting the need as referred to, and overcoming disadvantages of prior compensators. Basically, the system of the invention comprises:

(a) first structure including the crown block to receive applied loading, and subject to displacement generally in the direction of load exertion, (b) a base frame spaced from said first structure, and (c) means including groups of fluid actuator members pivotally connected to said base and to said structure for supporting said structure on the base, said members acting to resist said displacement of said structure characterized in that said base may move relatively toward and away from said structure while said loading continues to be applied to said structure, the actuators in each group extending in parallel relation.

Within this environment, the invention also comprises, in an additional aspect, the following:

(d) a sheave offset from the crown block and guidedly engageable with a line that extends from the crown block, (e) a first link connected to the sheave to pivot about a first axis defined by the sheave and also connected to the crown block, to pivot about a second axis adjacent the crown block, said first and second axes being parallel, (f) and a support link pivotally connected to the sheave, and also pivotally connected to the base frame to pivot about a third axis and to support the sheave in upwardly offset relation to the base frame.

Typically, the actuator members of each pair are interconnected along their lengths between pivotal connections to the base and said structure; in one form of the invention the actuator members of each pair are rigidly interconnection means (such as overlapping flanges) along their lengths between the pivotal connections to the base and said structure; and in another form, the actuator members of each pair are pivotally interconnected by connector members, at locations along their lengths between the pivotal connections to the base and said structure. Further, multiple pairs of actuator are typically provided; and in one form of the invention there are two pairs of said actuator members, at opposite sides of the path of said structure displacement; and in another form of the invention there are four pairs of said actuator members located at approximately equal intervals about the path of said structure displacement.

Further, each actuator typically includes a longitudinally extending piston chamber, a piston movable longitudinally therein, there being compressed gas in a first portion of the chamber at one side of the piston and against which the piston is urged by loading exerted by said structure, and there being liquid in a second portion of the chamber at the opposite side of the piston, and including flow passing means to pass liquid from said second portion of the chamber in response to movement of the piston toward said second portion of the chamber.

Typically, side load resisting clevis structures provide the pivotal connection to the base and said first structure; and when the two members of a pair have pivoted link interconnection, the two clevis connections to the base and/or first structure, for the two actuators, have spaced parallel pivot axes, and when the two members of a pair have rigid interconnection, the two clevis connections to the base and/or first structure, for the two actuators, have coaxial pivot axes.

Further, the invention is applicable to relatively movable base and first structure systems, as for example helicopter landing platforms and floating well derricks, whereby as the platform or first structure heaves upwardly in response to a rising sea, the base moves upwardly relative to the platform which substantially retains its elevation. A crown block may be carried or suspended by the first structure, and adjustable sheaves pass lines to the crown block, as will appear.

As will also appear, the first and support links for the sheave typically comprise end-pivoted trusses.

Additional advantages of the invention includes:

(a) Compression versus force applied is at an exponential rate rather than linear. This exponential increase is absorbed by an inverse exponential mechanical displacement, which eliminates any change in lifting force.

(b) Utilization of this mechanical displacement eliminates the need for high pressure piping or bottles.

(c) The reduced amount of air required makes it very advantageous to use nitrogen as the gas medium, and allows a standard nitrogen generator to be used to charge the system, for safety.

(d) The system significantly increases the effectiveness of the compensation while reducing overall weight, cost of materials and cost of construction.

(e) Provision of a derrick upper end construction that provides increased strength and stability, as for the crown positioned compensator.

These and other objects and advantages of the invention, as well as the details of an illustrative embodiment, will be more fully understood from the following specification and drawings, in which:

DRAWING DESCRIPTION

FIG. 1*a* is a side elevation showing a pair of interconnected actuators;

FIG. 1*b* is a top plan view showing a pair of connected actuators;

Figure 1A:
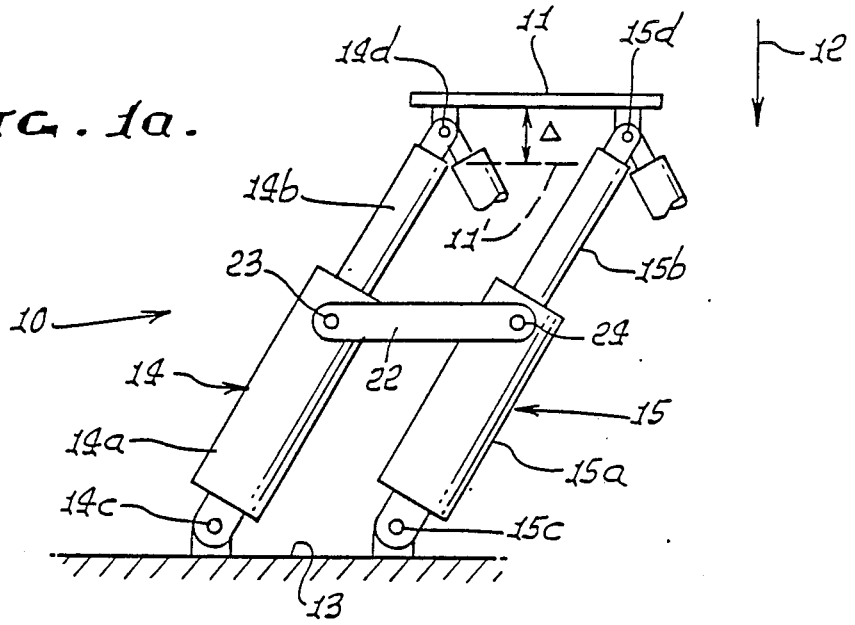
Figure 1B:
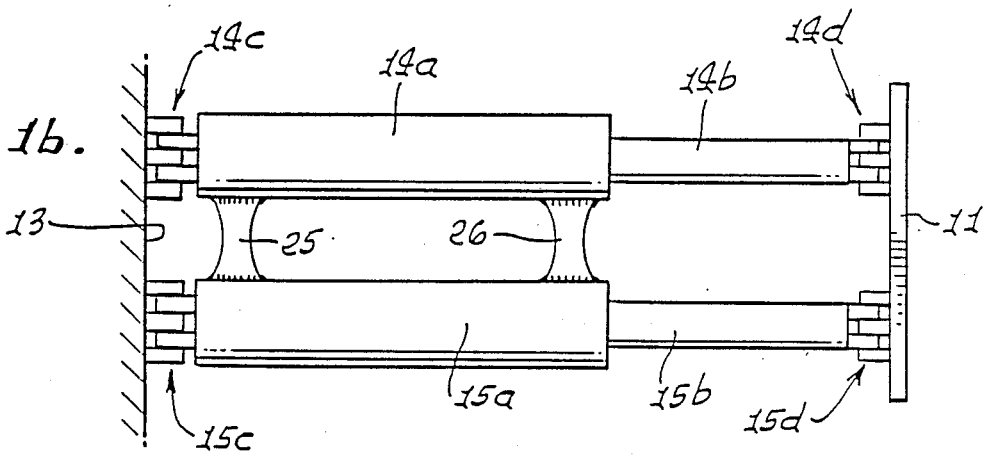
Figure 13:
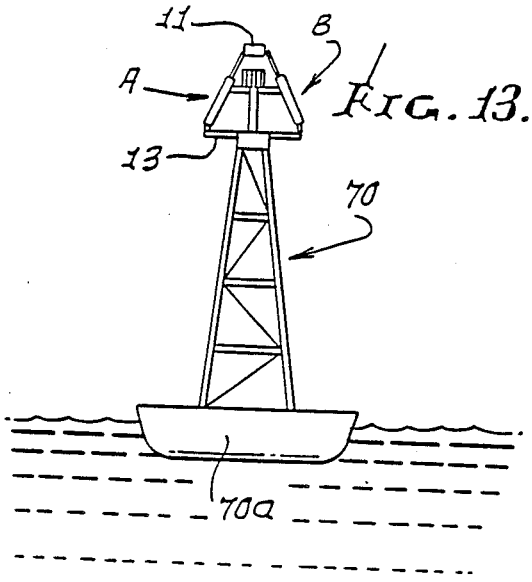
Figure 14:
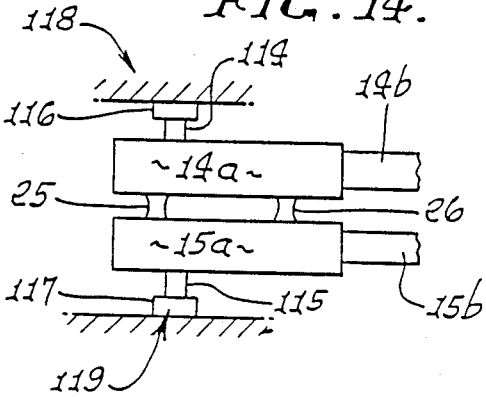
Figure 6A:
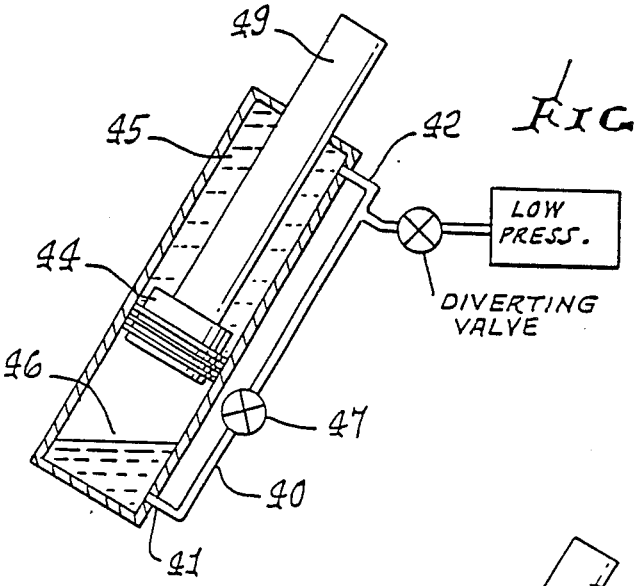
Figure 6B:
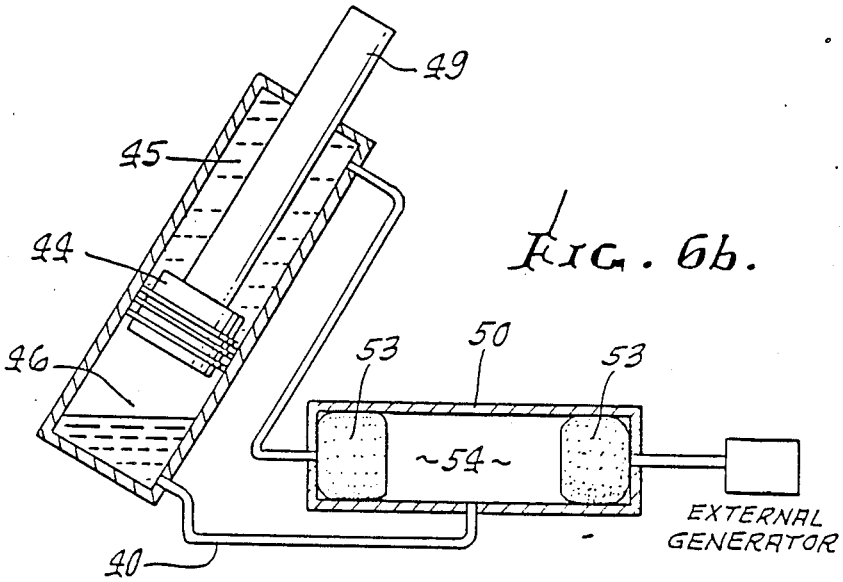
Figure 7:
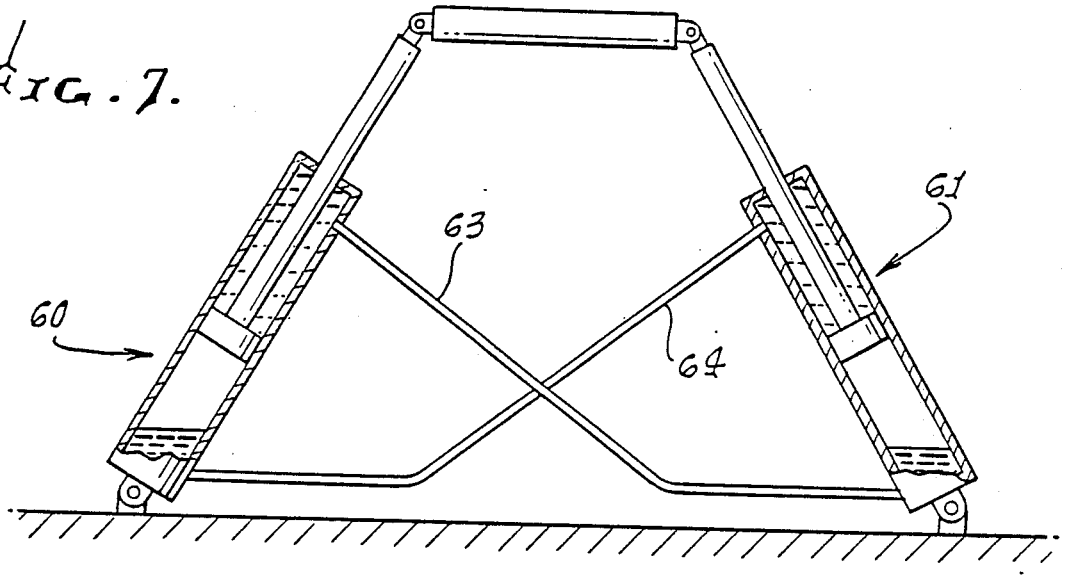
Figure 8A:
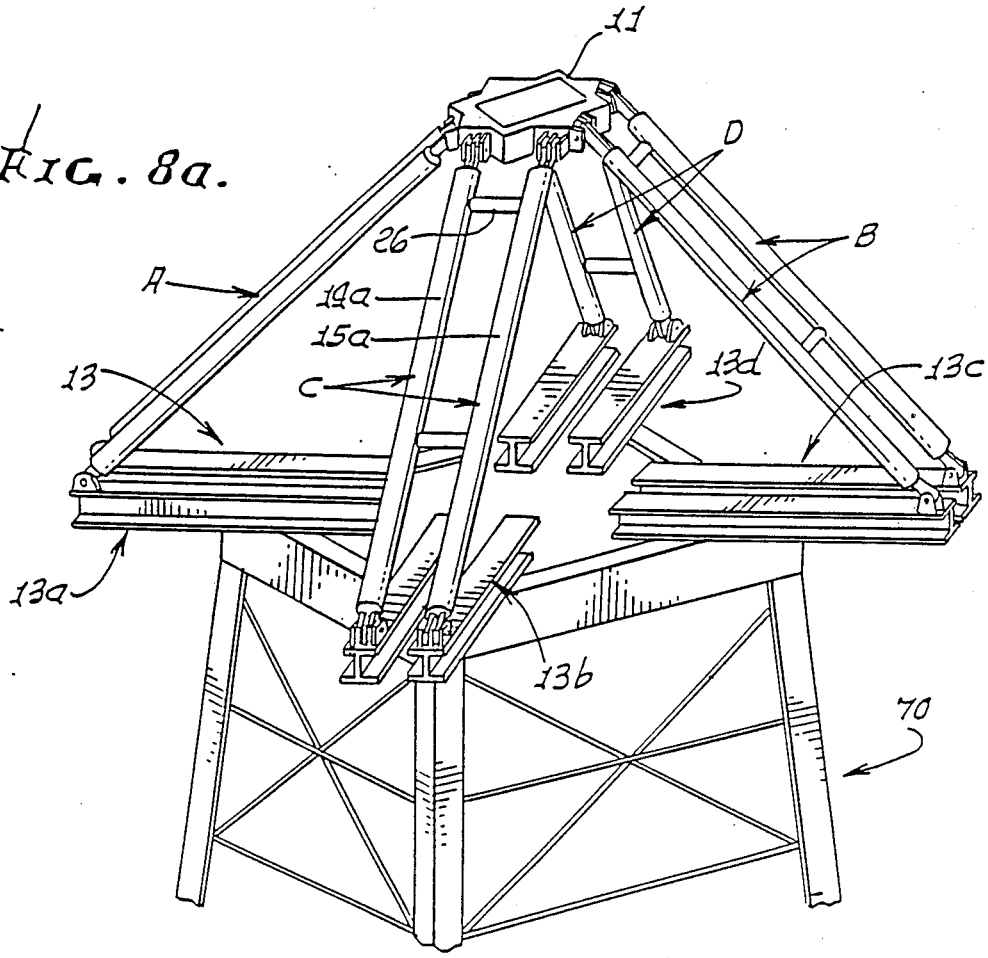
Figure 8B:
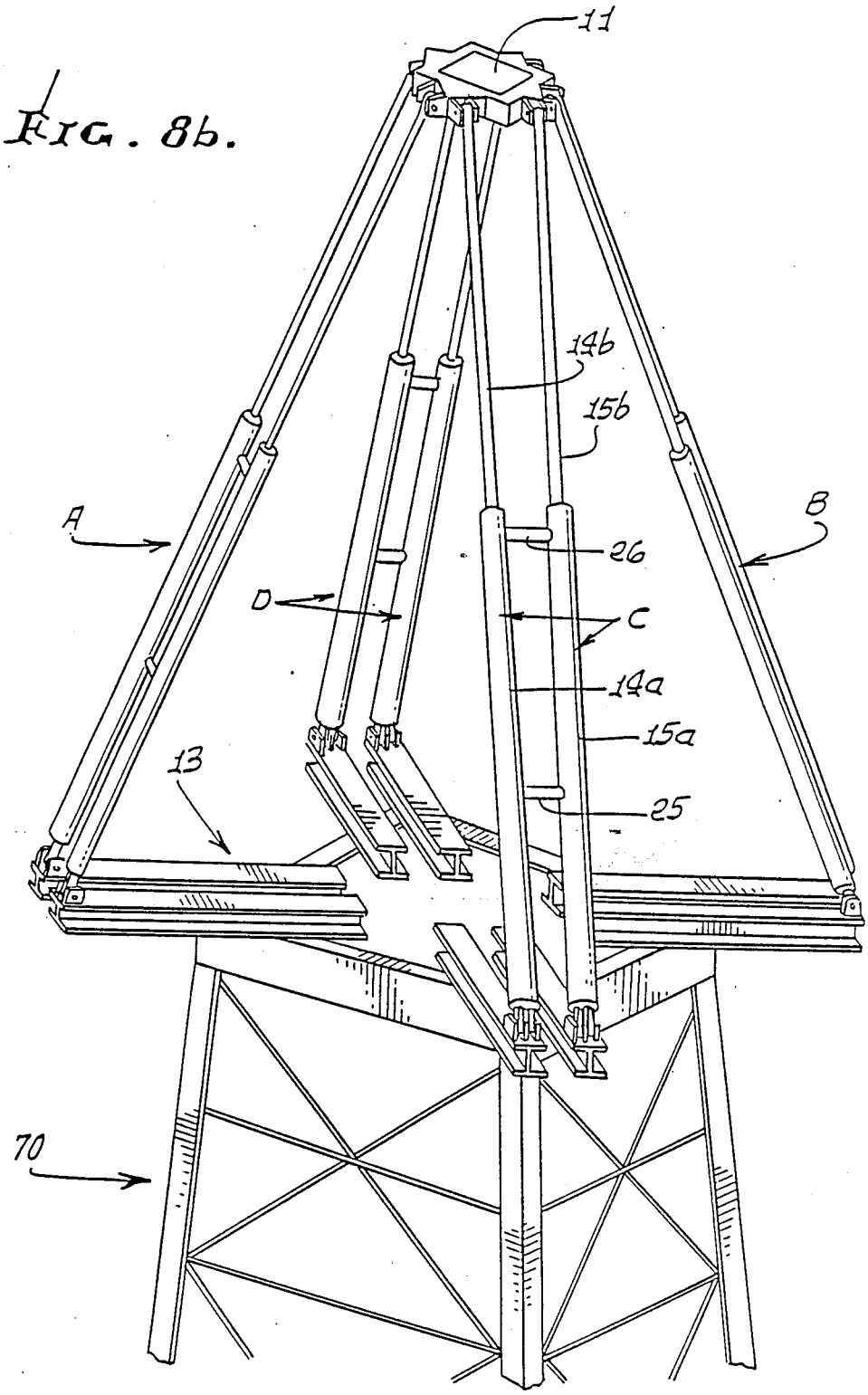
Figure 9:
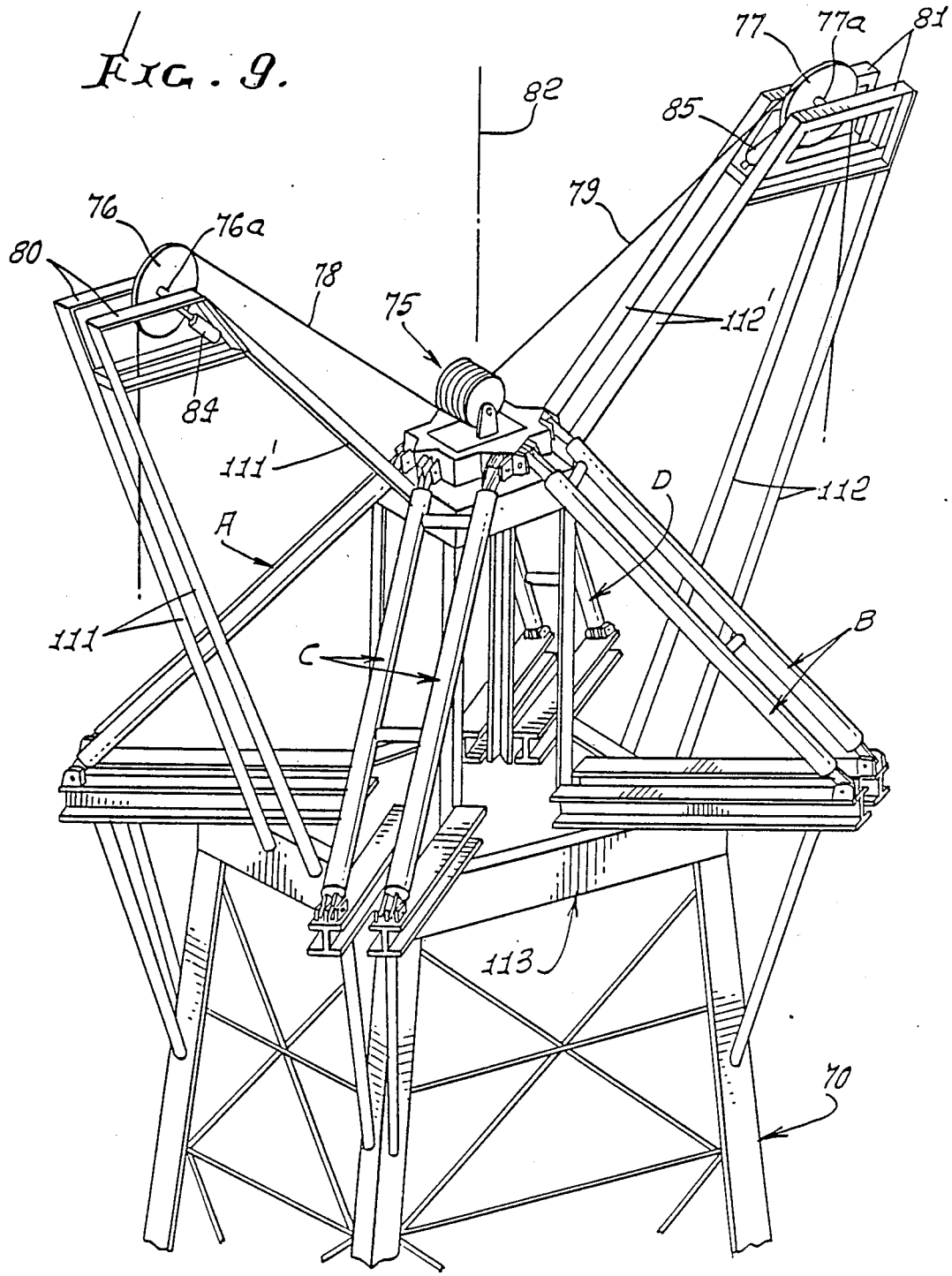
Figure 10:
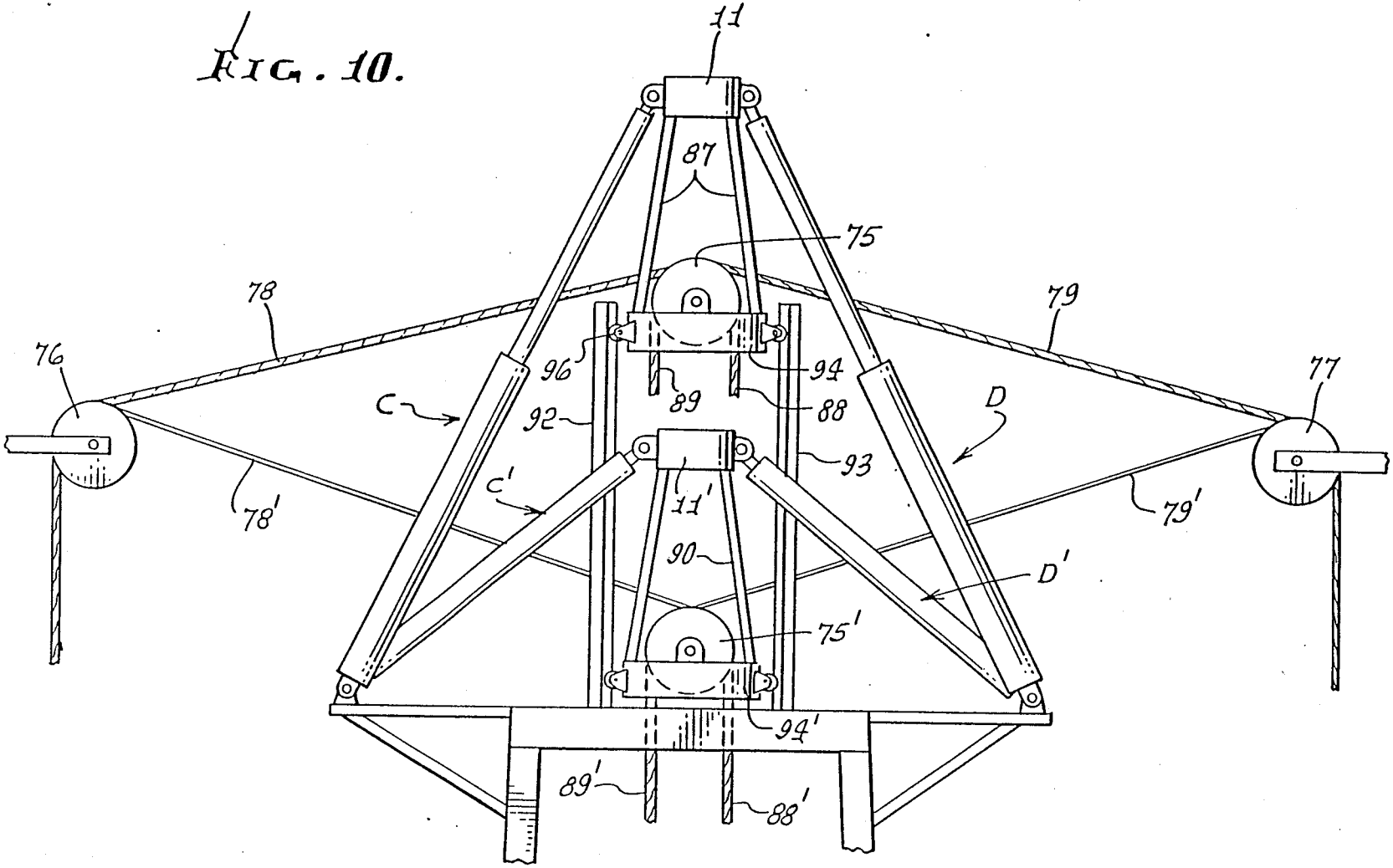
Figure 11:
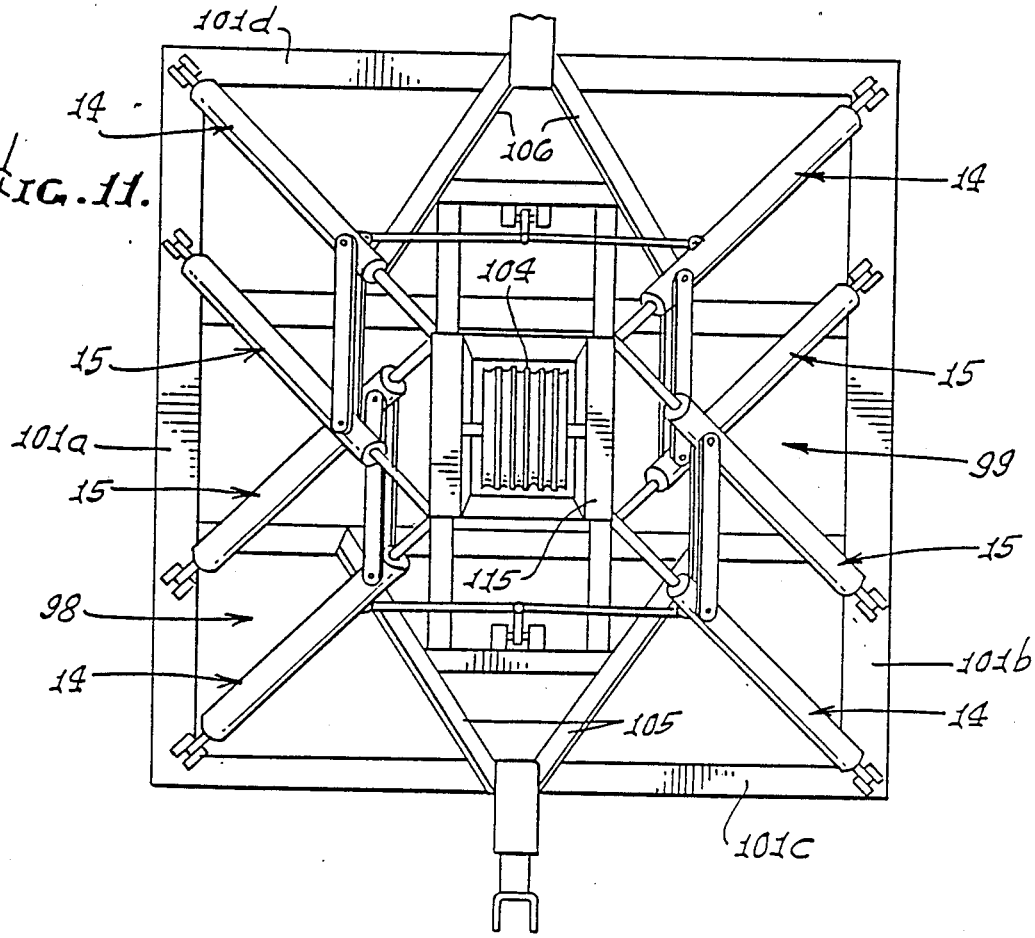
Figure 12:
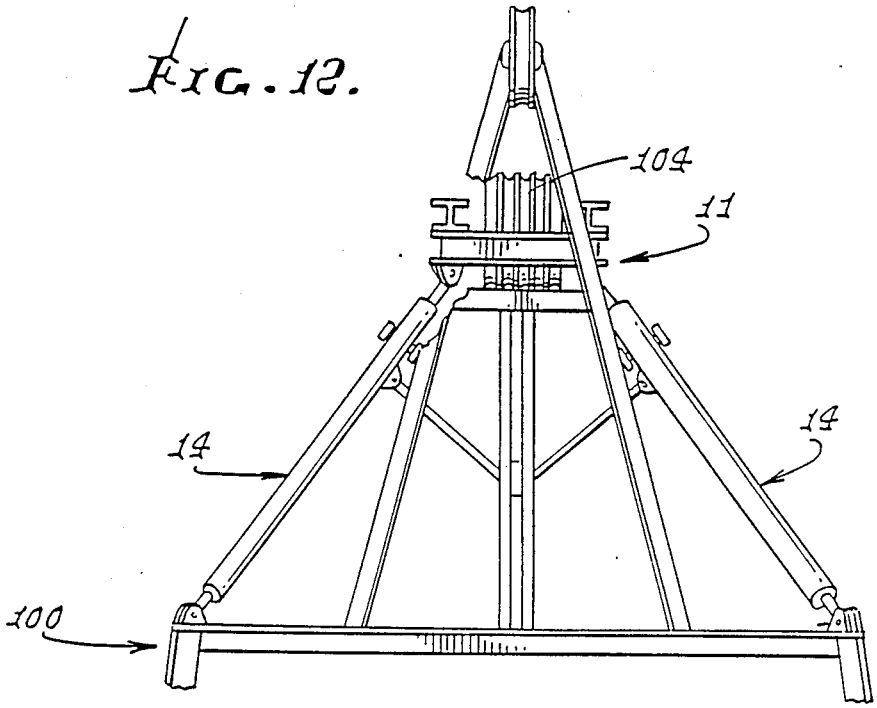
Figure 15:
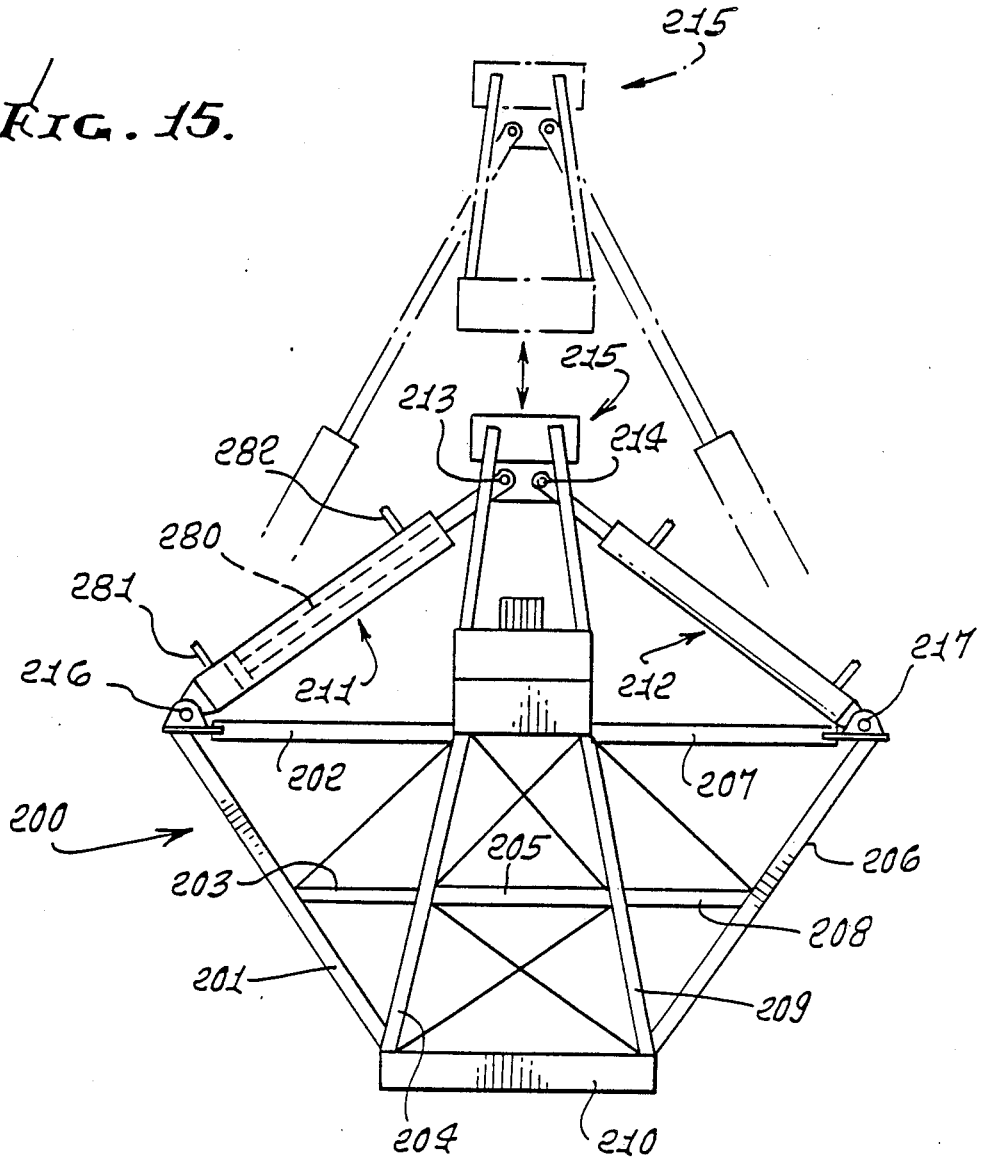
Figure 16:
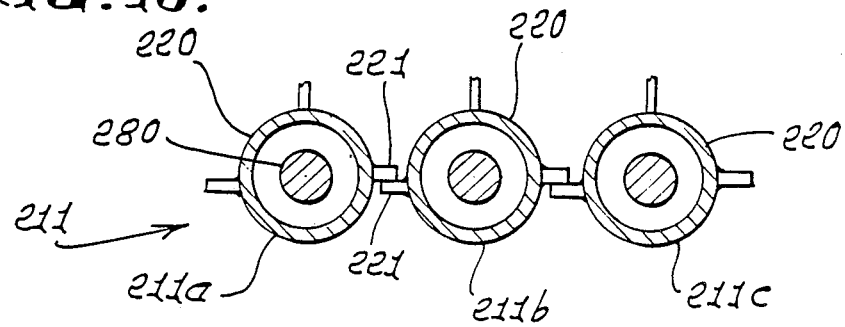
Figure 17:
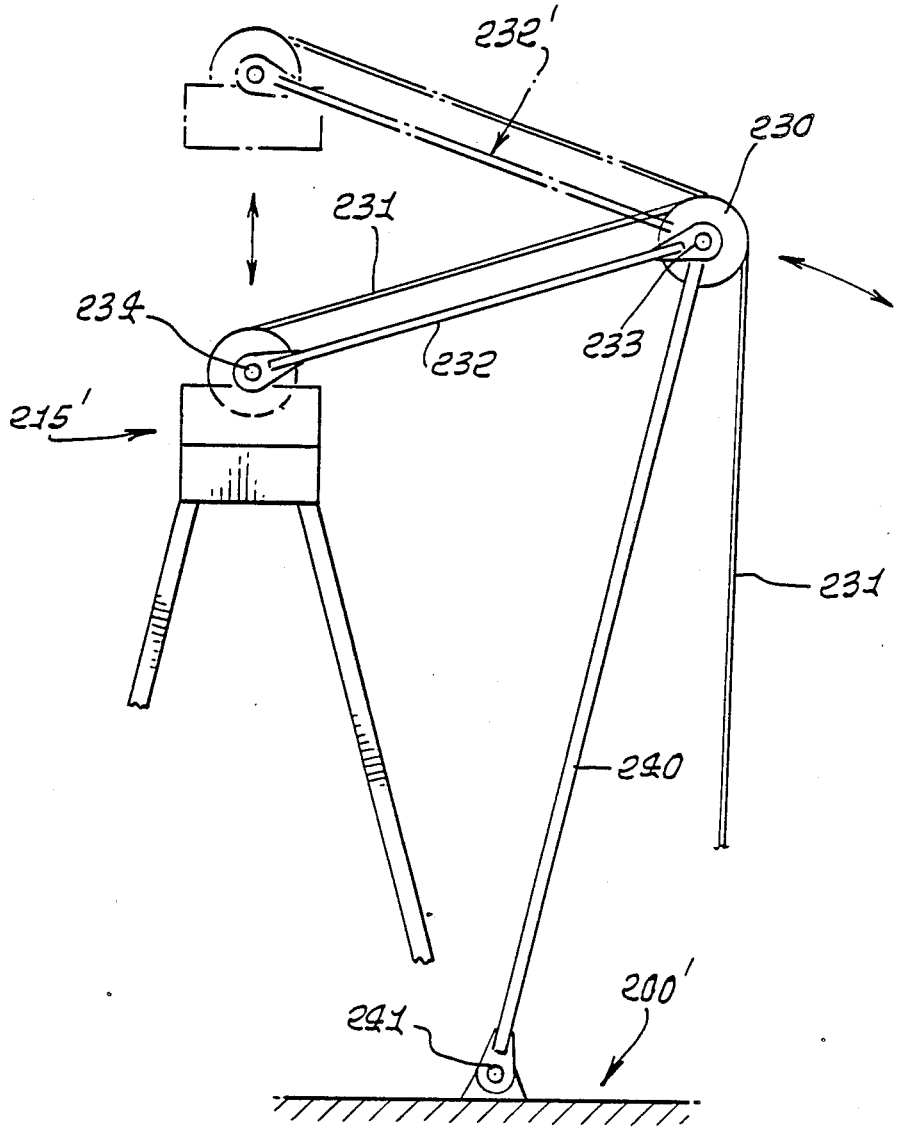
Figure 18:
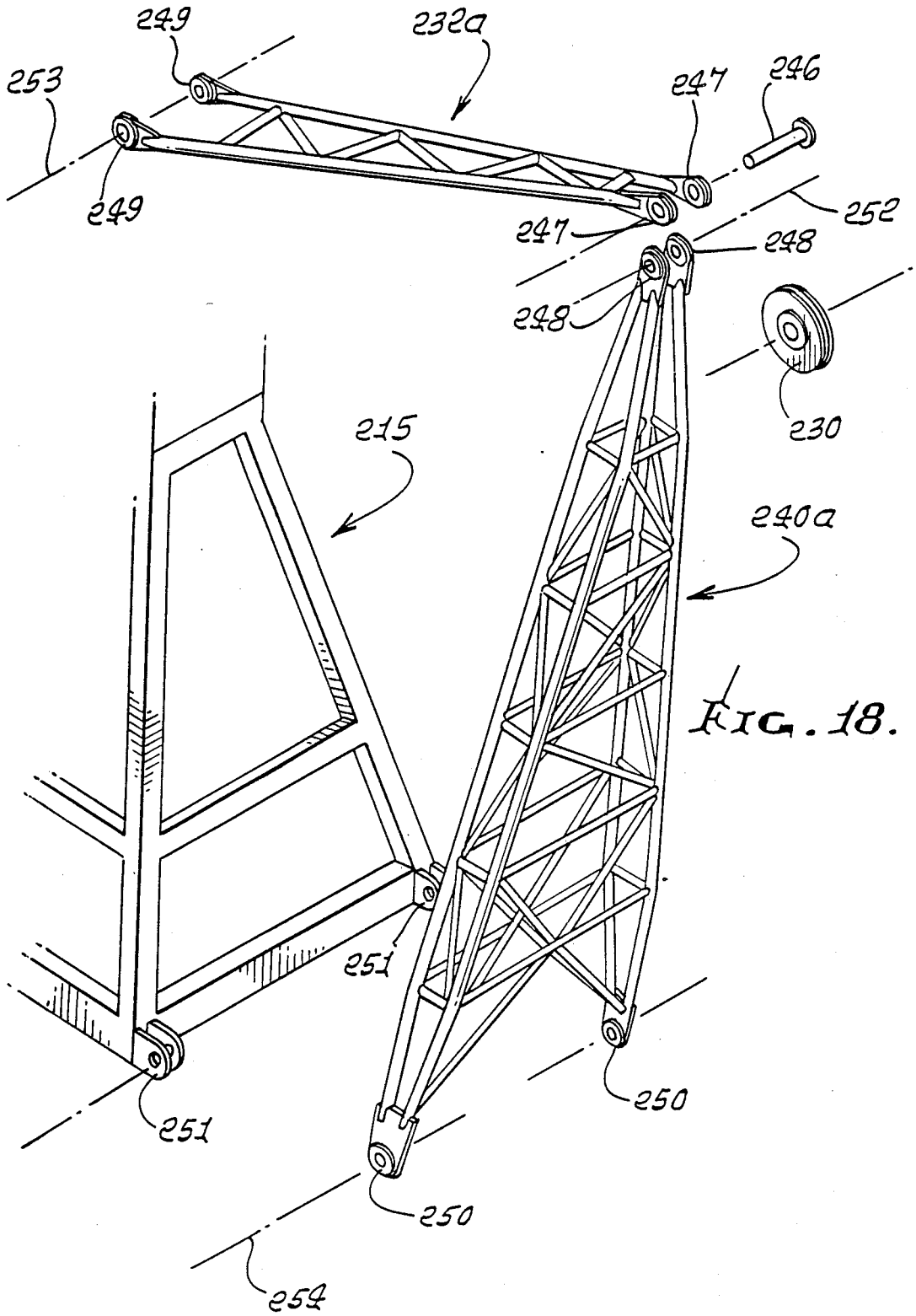

FIG. 6*a* and 6*b* are elevations showing actuator fluid interconnections;

FIG. 7 is a modified view showing actuator fluid interconnections;

FIGS. 8*a* and 8 *b* are perspectives showing application of the invention to a well derrick;

FIG. 9 is a view like FIGS. 8*a* and 8*b*, showing a modification;

FIG. 10 is an elevation showing a further modifications, applying the invention to a well derrick;

FIGS. 11 and 12 are plan and elevational views showing a further modification, FIG. 13 shows a derrick supported on a drilling vessel; and FIG. 14 is like FIG. 1*b*, and shows a modification, FIG. 15 is a side elevation showing a base frame, crown block and actuator group combination;

FIG. 16 is an enlarged section showing a bank or group of actuator cylinder tied together by web plates;

FIG. 17 is a schematic side elevation showing a break-over sheave, crown block and pivoted link combinations; and FIG. 18 is a perspective showing of the FIG. 17 combination wherein the pivoted links comprise trusses.

DETAILED DESCRIPTION

Referring first to FIG. 1*a*, the illustrated dynamic load compensation system 10 comprises a first structure 11 to receive applied loading indicated by force arrow 12, and subject to displacement as at Δ generally in the direction of applied loading, i.e. direction of arrow 12, and to a level 11'. Also provided is a base 13 spaced from first structure 11 and to which the loading is to be transferred. Finally, means is provided to include at least one pair of generally parallel fluid actuator members 14 and 15 pivotally connected to the structure 11 and base 13, as in the parallelogram relation illustrated; and such members 14 and 15 consequently act to resist the displacement Δ characterized in that the base 13 may move relatively toward and away from the structure 11 while loading continues to be applied to structure 11, i.e. the latter continues to support the load. For example, base 13 may move vertically toward and away from structure 11, but does not move laterally relative thereto, and/or structure 11 may move vertically toward and away from structure 13, but does not move laterally relative thereto. Thus, support 11 may represent a helicopter landing pad on a base such as floating ship, and support 11 may represent a crown block on a well derrick which is in turn supported on a floating ship.

Figure 2:
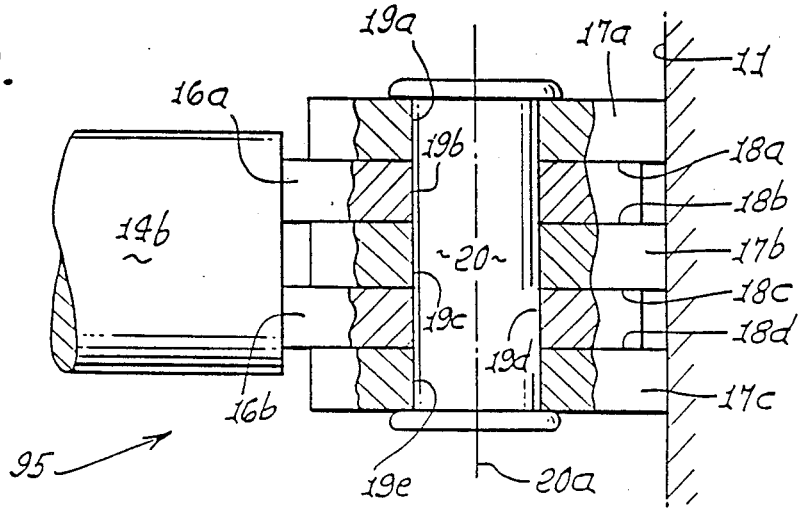
FIG. 2 is an enlarged plan view showing a double clevis construction.

In accordance with an important aspect of the invention, the members 14 and 15 are fluid actuators having cylinders 14*a* and 15*a* and piston plungers 14*b* and 15*b*, compressible fluid such as gas (nitrogen) contained by the cylinders is acting against the plunger pistons. The members 14 and 15 extend in parallel relation, and their connections 14*c* and 14*d*, and 15*c* and 15*d* to the elements 11 and 13 are such as to resist side loading in directions normal to the plane of FIG. 1*a*. A typical such connection is a clevis means 95 shown in FIG. 2, rod 14*b* having two laterally spaced supports 16*a* and 16*b* integrally attached to its end, and structure 11 having three laterally spaced supports 17*a*, 17*b* and 17*c* attached thereto. Supports 16*a* and 16*b* extend between supports 17*a*, 17*b*, and 17*c*, to have sliding relation with their sides at loci 18*a*, 18*b*, 18*c* and 18*d*; and a pivot pin 20 extends through openings 19*a*, 19*b*, 19*c*, 19*d* and 19*e* in the supports. Loci 18*a*–18*d* define parallel planes relative to which the axes of rod 14*b* and cylinder 14*a* remain parallel during pivoting, whereby, relative lateral movement of the structure 11 and base 13 is blocked as in the lateral direction of pin 20. If multiple pairs of such actuators are provided so that the axes of pins 20 of one pair are at an angle (as for example normal) to the axes of the pins of a second pair, relative displacement of structure 11 and base 13 in all lateral directions is blocked. This effect is enhanced by providing an interconnection or interconnections between the members 14 and 15 along their lengths between the pivot connections. See for example the connection link 22 between the cylinders 14*a* and 14*b* and pivotally connected to the latter at 23 and 24, the axes of such pivots being parallel to the axis 20*a* of pin 20; also the link is parallelogram connected to the actuators, as related to the pivoted connections of the latter to 11 and 13. Note that pin axes of supports 14*c* and 15*c* are spaced apart, and the pin axes of supports 14*d* and 15*d* are spaced apart, laterally.

Even further enhancement of lateral displacement resistance effect is obtained by rigidly interconnecting the members 14 and 15 along their lengths. See for example the plan view of FIG. 1*a*, wherein the elements are the same as in FIG. 1*b*, and correspondingly numbered, except for the rigid connections 25 and 26 between the cylinders 14*a* and 15*a*; also the pin axes of supports 14*c* and 15*c* are co-axial; and pin axes of supports 14*d* and 15*d* are co-axial. The parallelogram design also resists torsional bending forces, as by putting one actuator in tension and the other in compression. The double clevis design of FIG. 2 accomplishes a similar task, in that the two fixed hinges or pivots convert a free end bending moment section modulus to a fixed end section modulus. For example, torsional bending force places one clevis support 16*a* in tension, and the other clevis support 16*b* in compression as respects FIG. 2.

Figure 3:
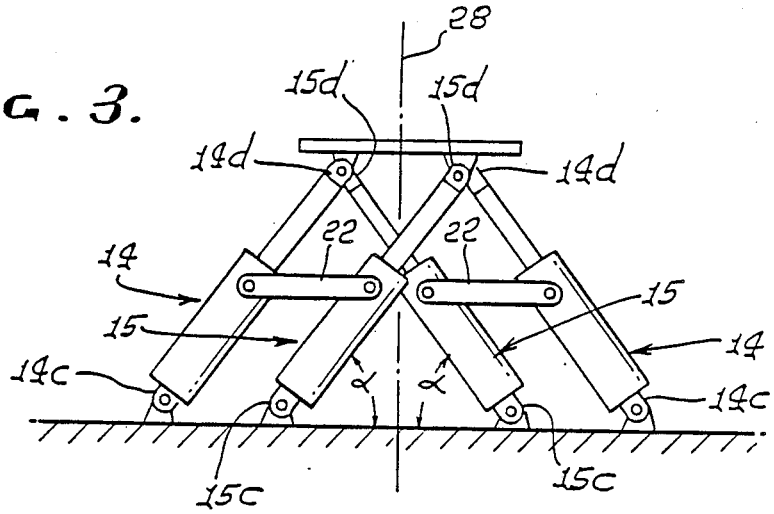
FIGS. 3 and 4 are elevations showing multiple pairs of actuators.

The system shown in FIG. 3 comprises two pairs of such actuators 14 and 15 connected between a base 13 and a structure 11, as in FIG. 1*a*. The pivots 14*c* and 15*c* of one pair are at one side of axis 28, and the pivots 14*c* and 15*c* of the other pair are at the opposite side of axis 28. The pivot 14*d* of actuator 14 of one pair is common to the pivot 15*d* of actuator 15 of the other pair, and the pivot 15*d* of the actuator 15 of the one pair is common to the pivot 14*d* of actuator 14 of the other pair, as shown. Thus, actuators 14 and 15 of the left pair are axially directed rightwardly and upwardly at angle $\alpha$ to the base; and actuators 14 and 15 of the right pair are axially directed leftwardly and upwardly at angle $\alpha$ to the base. Clevis pivot connections to 11 and 13 remain the same as in FIGS. 1*a* and 2; and all pivot connections have parallel axes. Note links 22, the same as in FIG. 1*a*.

Figure 4:
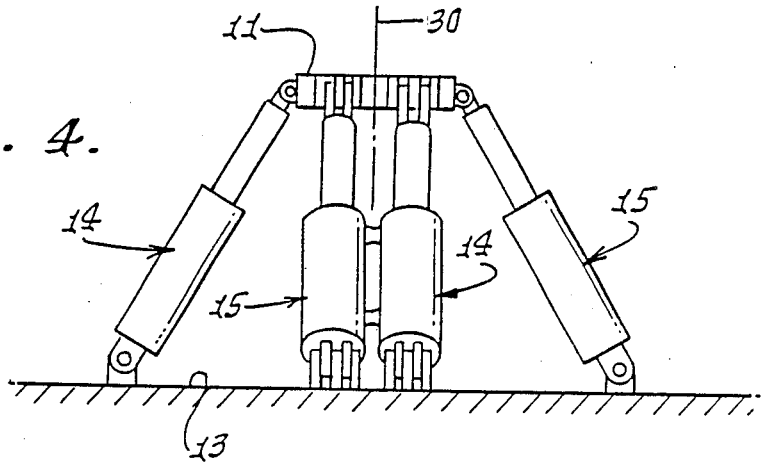

In FIG. 4 the construction incorporates four pairs of actuator members of the configuration as seen in FIG. 1*b*. The four pairs are spaced about a vertical axis 30; two of the four pairs are located at opposite sides of the axis 30 at 3 and 9 o'clock position; and the remaining two of the four pair are located at opposite sides of the axis 30, at 6 and 12 o'clock positions.

Figure 5:
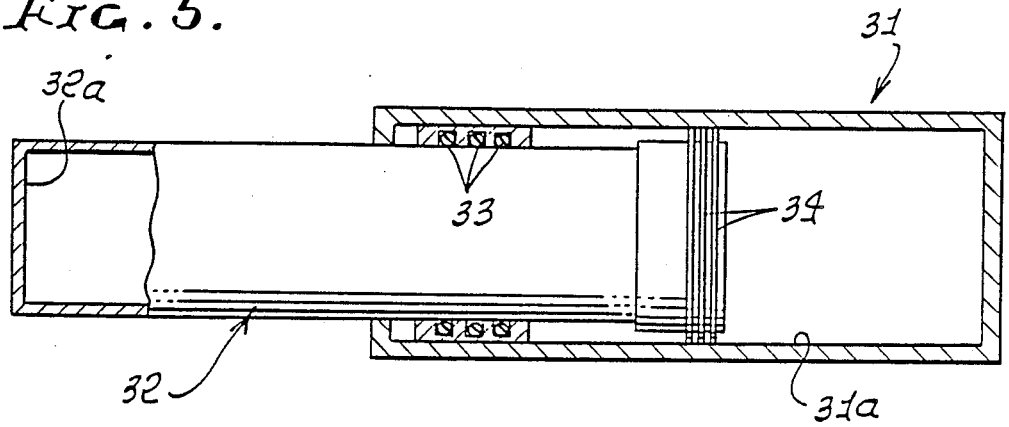
FIG. 5 is an elevation showing the construction of an actuator.

In both FIGS. 3 and 4, the multiple pairs of actuators act to reinforce one another, in opposing lateral forces. Typically, the axes of the actuators in each of FIGS. 3 and 4 share a common apex, allowing for a single interconnecting platform structure 11. Also the cylinders are mounted diagonally to oppose a vertical load. This diagonal mount causes the angle of the cylinder ($\angle\alpha$) to decrease as the elevation of the apex decreases. The resultant pressure increase in the cylinder is compensated for by the increased force required (by virtue of decrease in $\angle\alpha$) of the diagonal support in relation to the vertical load. The percent of compensation achieved is determined by the span and limits of the degree of motion ($\angle\alpha$). The cylinders utilized typically have hollow rods for the purpose of reduced weight and increased internal volume. Pressure seals are installed on the rod ends to create an effective piston area equal to the cylinder I.D., as seen in FIG. 5.

Note cylinder 31 having bore 31*a*, hollow rod 32, with fluid pressure exerted against piston face 32*a*; load bearing seals at 33, and piston seals at 34.

To further reduce excess variation which may be the result of an "other than optimum" angular span, the compression area volume is reduced as the rod extends. The most effective method to reduce internal volume is to use oil displaced by the "effective piston" to be introduced into the compression area either internally as in FIG. 6*a* or in an external reservoir as in FIG. 6*b*.

In FIG. 6*a*, a transfer duct 40 is connected at 41 to the cylinder below the piston level, and at 42 to the cylinder 43 above the level of piston 44, and liquid transfers from space 45 in the cylinder above the piston and about rod 46, to space 46 in the cylinder below the piston level, as the rod extends. Gas pressure in space 46, drives the liquid back to space 45, as the rod retracts. Typically, although this method reduces the "effective piston" area to that of the rod O.D. are, the corresponding increase in pressure required increases the volume to pressure ratio (i.e. the cylinder volume required for a 12" piston is now based on and I.D. of 14").

Further advantages of this feature are that:

1. the escape of the oil from this rod is regulated by the orifice size which will prevent excessive acceleration (orifice at 42);
2. the oil passage may be blocked by means of a valve which would stop further movement of the rod; (see valve 47); and
3. relieving pressure from the oil by means of a diverter valve to an additional low pressure reservoir increases the effective piston area/force for special contingencies with no increase in gas pressure.

In FIG. 6*b*, the construction is the same, except that an exterior reservoir 50 is connected into duct 40. See oil containing bladders 53, and gas space 54 between the bladders.

In FIG. 4, four pairs of cylinders are mounted to form two isosceles triangles with their base line at 90° to each and a common effective apex.

In FIGS. 8*a* and 8*b*, the four pairs of actuators, as in FIG. 4, are applied to a well derrick 70, near its top, to support a crown block platform structure 11. Beams 13*a*–13*d* represent the base 13, supported at the top of the derrick. In FIG. 8*a* the rods are retracted, and in FIG. 8*b* they are extended. The four pairs of actuators are indicated at A, B, C and D. See also FIG. 13, the derrick 70 supported by floating vessel 70*a*.

In FIG. 9, the construction is the same as in FIGS. 8*a* and 8*b*; however, the crown block appears at 75, and sheaves 76 and 77 are adapted to support control lines 78 and 79 to the crown block. The sheave axles 76*a* and 77*a* are supported at 80 and 81 for movement toward and away from the vertical central axis 82, to compensate for extension and retraction of the actuators. Sheave shifting actuator appear at 84 and 85. A similar arrangement appears in FIG. 10, except that the crown block 75 is suspended at 87 from structure 11. Well equipment is suspended via lines 88 and 89, by the block 75. Also, another platform structure 11' is supported by base 13, via additional pairs of actuators indicated at C' and D', and of the FIG. 4 type. See also the second suspended crown block 75', a suspension indicated at 90. Lines 88' and 89' also suspend well equipment. Lines 78' and 79' extend from sheaves 76 and 77 to block 75'. Vertical guides are shown at 92 and 93 to guide up and down movement of the supports 94 and 94' for blocks 75 and 75'. Anti friction rollers 96 carried by 94 and 94' ride up and down in guide grooves 97 in 92 and 93. Sheave support structure appears at 111, 111', 112 and 112' in FIGS. 9 and 10. Structures 111' and 112' may extend to base beams 113, as do structures 111 and 112.

FIGS. 11 and 12 show two sets 98 and 99 of actuators of the type seen in FIG. 3, applied to a well derrick 100, near its top, to support a crown block platform structure 11. Beams 101*a*–104*a* represent the base 13, supported at the top of the derrick. The operation is the same previously described and the supported crown block is shown at 104, having several annular pulley grooves for the line or lines that in turn support the well equipment. Control line sheaves 76 and 77 are arranged as in FIG. 9. Supports for the sheaves appear at 105 and 106.

In FIG. 14, the structure is the same as in FIG. 1*b*, and carries the same numerals, except that connections 14*c* and 15*c* are omitted; instead trunnions 114 and 115 are integral with the two cylinders, and rotatable in bearings 116 and 117 on fixed support structures 118 and 119. Thus, side loads are resisted, and axial loading is transmitted to 118 and 119.

Referring to FIG. 15, the base frame 200 includes frame elements 201–210. Cylinder banks 211 and 212 project diagonally upwardly and oppositely, as shown, to pivotally connect at 213 and 214 to compensating crown block 215 note pivotal connections 216 and 217 of the lower ends of the actuator banks or groups to the base frame. The lowered condition of the crown block is shown in full lines, whereas in full raised position the block appears in broken lines. Note the indicated broken line positions of the extended actuator banks.

The base frame performs two basic functions critical to the success of the compensator. The base frame's first function is to provide positioning and support for the crown block 215 while it is locked in the lowered position, operating as a conventional crown. Its second function is to provide a stable base for the cylinder banks while the crown is in the operational mode. When the crown is compensating, i.e. moving up or down, the base must withstand both the compressive load due to suspended weight and the moments generated due to lateral acceleration of the entire drill mast.

The actuators are banked three across (see FIG. 16) and the tubes of each actuator cylinder 220 are tied or connected to each other by web plates 221 attached to the cylinder. The webs are welded or bolted together, and extend lengthwise of the cylinder. The cylinders also perform two functions critical to the success of the compensator. First, the cylinders provide the force for the actual suspension of the crown block, as described earlier herein. Second, by being tied together in multiple units, they improve the rigidity of the joint perpendicular to the axes of pivoting. The number of cylinders that can be banked together may vary. With each cylinder that is added to the bank, a "stiffer" beam is formed about the principle axis of the central cylinder, or cylinder pair. This method of construction also allows for the mounting of auxiliary equipment on the outer two cylinders, as for example ladders, pressure vessels and other hydraulic components. The cylinders are typically aligned by pins and secured by bolts, with each cylinder being identical in construction.

The compensating crown block 215 also serves two functions. First, it supports the crown which forms the "fixed" part of the well equipment suspension system. Second, it serves to balance the loading on the two cylinder banks. It effects the balance due to the fact that the cylinder rod end pins at the crown block are not concurrent. The lateral separation of the pivot pins forces the crown block to rotate if there is a force imbalance in the cylinders; this rotation displaces the crown angularly which creates a force due to suspension that seeks to restore it to the central position.

The actuators also include piston rods 280 received in the cylinder. Fluid pressure control lines 281 and 282 extend to chambers at opposite ends of a piston connected to each rod, in the cylinder.

Referring now to FIG. 17, the base frame and crown block are schematically indicated at 200' and 215'. FIG. 17 shows the addition of break-over or idler sheave 230 for a line 231 that extends between the block 215' and spooling equipment at the drilling rig deck, for example. Also included are a first link 232 and a second link 240. Link 232 is pivotally connected at 233 to the sheave axle to pivot about a first axis (the sheave axis) and also pivotally connected at 234 to the crown block, to pivot about a second axis adjacent to the block, the first and second axes being parallel. The second or support link 240 is also pivotally connected at 233 to the sheave axle to pivot about the first axis, and also pivotally connected at 241 to the base frame to pivot about a third axis that is parallel to the first and second axes. Link 240 extends upwardly and outwardly, relative to the base frame, and link 232 extends generally inwardly from the sheave to the crown block, link 240 being longer than link 233. In crown block down position, link 232 extends inwardly and downwardly as shown in full lines, whereas in block upward and compensating position, the link 232 extends inwardly and upwardly, as per the broken line position 232'.

The sheave serves as an entry point to the crown, similar to that on a standard non-compensating crown; however, since the crown is a movable device, the relationship between the crown and the break-over sheave must be "fixed" to prevent ton-mile accumulation on the drill line. This is accomplished by the spacer bar or link 232 which maintains a constant distance between the crown block sheave and the break-over sheave. The sheave support bar or line 240 is a structure adequate to support the loads on the break-over sheave created by tension in the line 231. The support bar or link also defines the third leg of the triangle that provides constant relative positioning for the break over sheave. This system completely eliminates line translation as a result of crown movement, whereby elimination of ton-mile accumulation is achieved.

FIG. 18 is a perspective exploded view showing link 232 in the form of a truss **232*a*, and link 240 in the form of a truss 240*a*. Note sheave 230; sheave axle 246; pivot bearings 247 for axle 246 defined by truss 232*a*; pivot bearings 248 for axle 246 defined by truss 240*a*; pivot bearings 249 defined by truss 232*a* for pivoted attachment to the crown block; and pivot bearings 250 defined by truss 240*a* for pivotal attachment to the base frame at 251. Axes 252-254** defined by the bearings are parallel.

This continuation-in-part application incorporates by reference all of parent application Ser. No. 783,679, now U.S. Pat. No. 4,662,786 issued May 5, 1987.

I claim:

1. In a dynamic load compensating system, for supporting a crown block, the combination comprising (a) first structure including the crown block to receive applied loading, the subject to displacement generally in the direction of load exertion, (b) a base frame spaced from said first structure, and (c) means including groups of generally parallel fluid actuator members pivotally connected to said base frame and to said structure for supporting said structure on the base, said members acting to resist said displacement of said structure characterized in that said base may move relatively toward and away from said structure while said loading continues to be applied to said structure, the actuators in each group extending in parallel relation, the actuator members of each group being interconnected along their lengths between their pivotal connections to the base frame and said first structure, so as to extend in and remain in side-by-side relation during actuation, the actuators of each pair including pistons and cylinders, the cylinders being directly interconnected proximate the ends of the cylinders from which the pistons emerge, there being two groups of said actuator members, respectively at opposite sides of the path of said structure displacement, the actuators of each pair having like inclinations to said path, and from vertical, and there being side load resisting clevis devices pivotally connecting each of the actuators at its opposite ends respectively to said base frame and to said first structure.

(d) and including a sheave offset from the crown block and guidedly engageable with a line that extends from the crown block, a first link connected to the sheave to pivot about a first axis defined by the sheave and also connected to the crown block to pivot about a second axis adjacent the crown block, said first and second axes being parallel.

2. The combination of claim 1 wherein the actuator members of each group are interconnected along their lengths between the pivotal connections to the base and said structure.

3. The combination of claim 1 wherein adjacent actuator members of each group are rigidly interconnected by interconnection means along their lengths between the pivotal connections to the base and said structure.

4. The combination of claim 3 wherein said interconnection means include overlapping flanges on adjacent actuators, the flanges extending lengthwise of the actuator members.

5. The combination of claim 1 wherein there are two groups of said actuator members, at opposite sides of the path of said structure displacement.

6. The combination of claim 1 wherein there are four groups of said actuator members, located at approximately equal intervals about the path of said structure displacement.

7. The combination of claim 1 including a well derrick on which said structure is supported.

8. The combination of claim 7 including a floating offshore drilling platform supporting said derrick, whereby as the platform heaves upwardly in response to a rising sea, the base frame moves upwardly relative to the platform which substantially retains is elevation.

9. The combination of claim 8 including a well pipe supporting line connected to said crown block to raise and lower the well pipe, the crown block being movable to extend or shorten the line effective length in response to said upward or downward displacement, respectively, of the drilling platform, whereby the crown block maintains its approximate elevation relative to the sea bed.

10. The combination of claim 9 including a sheave on the derrick offset from the crown block and guidedly engaging said line.

11. The combination of claim 1 wherein said first link comprises a primary truss.

12. The combination of claim 1 including a support link pivotally connected to the sheave, and also pivotally connected to the base frame to pivot about a third axis and to support the sheave in upwardly offset relation to the base frame, said first, second and third axes being parallel.

13. The combination of claim 12 wherein the support link comprises a secondary truss.

14. In a dynamic load compensating system, for supporting a crown block, the combination comprising (a) first structure including the crown block to receive applied loading, and subject to displacement generally in the direction of load exertion, (b) a base frame spaced from said first structure, and (c) means including groups of fluid actuator members pivotally connected to said base and to said structure for supporting said structure on the base, said members acting to resist said displacement of said structure characterized in that said base may move relatively toward and away from said structure while said loading continues to be applied to said structure, the actuators in each group extending in parallel relation, the actuator members of each group being interconnected along their lengths between their pivotal connections to the base frame and said first structure, so as to extend in and remain in side-by-side relation during actuation, the actuators of each pair including pistons and cylinders, the cylinders being directly interconnected proximate the ends of the cylinders from which the pistons emerge, there being two groups of said actuator members, respectively at opposite sides of the path of said structure displacement, the actuators of each pair having like inclinations to said path, and from vertical, and there being side load resisting clevis devices pivotally connecting each of the actuators at its opposite ends respectively to said base frame and to said first structure, (d) and including a well derrick on which said structure is mounted, and a floating offshore drilling platform supporting said derrick, whereby as the platform heaves upwardly in response to a rising sea, the base frame moves upwardly relative to the platform which substantially retains its elevation, (e) a well pipe supporting line connected to said crown block to raise and lower the well pipe, the crown block being movable to extend or shorten the line effective length in response to said upward or downward displacement, respectively, of the drilling platform, whereby the crown block maintains its approximate elevation relative to the sea bed, (f) a sheave on the derrick offset from the crown block and guidedly engaging said line, (g) and including a first link connected to the sheave to pivot about a first axis defined by the sheave and also connected to the crown block to pivot about a second axis adjacent the crown block, said first and second axes being parallel.

15. The combination of claim 14 wherein said link comprises a primary truss.

16. The combination of claim 14 including a support link pivotally connected to the sheave, and also pivotally connected to the base frame to pivot about a third axis and to support the sheave in upwardly offset relation to the base frame, said first second and third axes being parallel.

17. The combination of claim 16 wherein the support link comprises a secondary truss.

18. A load compensating system that comprises (a) first structure including a crown block to receive applied loading, and subject to displacement generally in the longitudinal direction of load exertion, (b) a base frame spaced from said first structure, and (c) means including groups of generally parallel actuator members pivotally connected to said base frame and to said structure for supporting said structure on the base frame, said members acting to resist said displacement of said structure characterized in that said base frame may move relatively toward and away from said structure while said loading continues to be applied to said structure, the actuators in each group extending in parallel relation, the actuator members of each group being interconnected along their lengths between their pivotal connections to the base frame and said first structure, so as to extend in and remain in side-by-side relation during actuation, the actuators of each pair including pistons and cylinders, the cylinders being directly interconnected proximate the ends of the cylinders from which the pistons emerge, there being two groups of said actuator members, respectively at opposite sides of the path of said structure displacement, the actuators of each pair having like inclinations to said path, and from vertical, and there being side load resisting clevis devices pivotally connecting each of the actuators at its opposite ends respectively to said base frame and to said first structure, (d) a sheave offset from the crown block and guidedly engageable with a line that extends from the crown block, (e) a first link connected to the sheave to pivot about a first axis defined by the sheave and also connected to the crown block, to pivot about a second axis adjacent the crown block, said first and second axes being parallel, (f) and a support link pivotally connected to the sheave, and also pivotally connected to the base frame to pivot about a third axis and to support the sheave in upwardly offset relation to the base frame.

19. The system of claim 18 wherein said first and support links comprise trusses, the support link being longer than the first link, and extending upwardly, the first link extending generally horizontally as the crown block moves from a down position to an up position.

20. The system of claim 18 wherein said first, second and third axes are parallel.

* * * * *